United States Patent [19]

Allen

[11] Patent Number: 4,630,024

[45] Date of Patent: Dec. 16, 1986

[54] GRID RESISTOR AND IMPROVED GRID ELEMENT THEREFOR

[75] Inventor: David W. Allen, Elsmere, Ky.

[73] Assignee: Post-Glover Resistors, Inc., Erlanger, Ky.

[21] Appl. No.: 655,933

[22] Filed: Sep. 28, 1984

[51] Int. Cl.[4] ..... H01C 1/08

[52] U.S. Cl. ..... 338/58; 219/552; 338/235; 338/280; 338/293

[58] Field of Search ..... 338/58, 235, 283, 280, 338/293, 333, 319, 234; 219/552

[56] References Cited

U.S. PATENT DOCUMENTS

| | | | |
|---|---|---|---|
| 723,788 | 3/1903 | Wales | 338/58 |
| 1,505,072 | 8/1924 | Walmsley | 338/58 X |
| 2,128,222 | 8/1938 | DuBois . | |
| 3,212,045 | 10/1965 | Weyenberg . | |

OTHER PUBLICATIONS

Post Glover "Nonbreakable Steel Grid Resistors", Bulletin No. 500R.

Post Glover "Nonbreakable Steel Grid Resistors" Bulletin No. 500.

Post Glover Resistors, Inc. "Stamped Grid Resistors vs. Wound Wire Resistors".

*Primary Examiner*—Harold Broome

*Assistant Examiner*—Marvin M. Lateef

*Attorney, Agent, or Firm*—Wood, Herron & Evans

[57] ABSTRACT

A grid resistor assembly includes a plurality of flat grid resistor elements. Each element includes at least one open-ended loop having side portions and a tip end portion connected together through intervening strip portions of narrower width than the side portions to improve current carrying capacity and to provide for more even heating and heat dissipation. An assembly of such elements is particularly used as a resistor box in an electric, motor-driven, transit vehicle, such as a subway car, and is provided in a predetermined space envelope to perform predetermined electrical parameters.

23 Claims, 4 Drawing Figures

GRID RESISTOR AND IMPROVED GRID ELEMENT THEREFOR

This invention relates generally to grid resistors and to an improved form of grid resistor element for use in grid resistors. The invention is disclosed particularly in relation to a punched-grid resistor assembly for use with electric motor-driven transit cars.

As will be noted below with regard to an exemplary embodiment, the invention will find advantageous, but not exclusive, use in the form of resistance devices which are used to provide a start-up load and a dynamic braking load for electric motors on transit cars. Types of such transit cars include, for example, the motorized cars making up subway and elevated trains and the individual cars in trolley systems.

A typical subway car, for instance, carries several relatively low resistance resistor boxes having a high rated current capacity. These resistor boxes are mounted on the underside of the subway car above the tracks upon which the car travels. In order to provide sufficient clearance above the cracks, and to maintain the resistor boxes within the length and width dimensions of the car, there are certain dimensional constraints on the "envelope" occupied by the resistor boxes.

In one present form of subway car, four such resistor boxes are arranged in a row beneath one side of the car between the front and rear wheels of the car. There are three additional resistor boxes beneath the other side of the car. Each of these resistor boxes occupies an "envelope" of space 16 inches long (from front to rear), 20 inches wide (laterally), and 14 inches in height. In another present form of subway car, there are two such resistor boxes beneath each side of the car. In this case, each box occupies an "envelope" of space having a length of approximately 29 inches, a width of approximately 20 inches, and a height of approximately 14 inches.

The resistor boxes on subway cars have a limited life span for several reasons. One reason is the oxidation of resistor elements in the resistor boxes. Since the resistors in the resistance boxes are intermittently subjected to extremely high currents, the resistors are intermittently heated to several hundred degrees centigrade above the ambient temperature and then permitted to cool. Such intermittent extreme heating and subsequent cooling stresses the resistor elements in the resistance boxes and causes oxidation of individual resistor components in the boxes.

Prior known resistor boxes typically contain a number of edge-wound resistors, each made up of a resistance element in the form of a coil on a ceramic insulating core. These edge-wound resistors are often connected in parallel within the resistor box to obtain the high current capacities required. Certain physical characteristics of these edge-wound resistors limit their heat dissipation capabilities, exacerbating the cyclic heating problems of the resistor elements. For example, the width of the edge-wound resistance element coil of a typical edge-wound resistor used in such resistor boxes is limited to a width of about three-quarters of an inch. This is because it is difficult to edge wind a resistive element using a metal "ribbon" of suitable thickness having a much greater width than three-quarters of an inch.

In addition, the "loops" of the spiral of the edge-wound "ribbon" must be suitably spaced apart to prevent shorting between the loops and to permit adequate cooling air flow.

Consequently, due to these coil width and spacing limitations, there is a limit to the mass of the resistance elements which can be contained within the requisite "envelope" of space for a resistor box using edge-wound resistors. The resistance element mass limitations of such edge-wound resistors in turn limit the steady state and transient current carrying capabilities of such edge-wound resistor boxes.

Edge-wound resistors in subway car resistor boxes also suffer from damage due to mechanical vibration and other mechanical stresses. In particular, the ceramic core structure of an edge-wound resistor is subject to breakage from mechanical shock, vibrations, thermal shock (e.g., water splashing on hot ceramic components), and other stress forces on the resistor box.

Because of the foregoing electrical load and mechanical stress problems, it is necessary to replace defective resistor boxes on subway cars periodically with new resistor boxes. Such replacement resistor boxes must fit within the same "envelope" of space beneath the subway car as the original boxes. The replacement resistor boxes must also at least meet the resistance and current-carrying capabilities of the original resistor boxes.

It is one general aim of the present invention to provide an improved resistor box for transit cars of the foregoing type. Such an improved resistor box could be provided as a replacement box or, alternatively, as original equipment on the transit car.

This objective has been met in accordance with certain principles of the invention by providing a resistor box for transit cars of the foregoing type which utilizes a grid resistor assembly rather than an edge-wound resistor assembly. In the form of resistor box disclosed, a punched-grid resistor assembly is employed.

As described in commonly assigned U.S. Pat. No. 2,128,222, punched-grid resistors are made up of a number of individual grid elements, each of which is an integral stamping from suitable electrical sheet steel. Each grid element has a pair of end lugs with perforations therein connected by a flat strip forming a circuitous path made up of a succession of oppositely extending open-ended loops connected in a series between the lugs. The individual grid elements of a punched-grid resistor are typically mounted in banks, each bank forming a "stack" of the grid elements uniformly spaced apart from one another. The grid elements in a bank are mechanically secured on insulating tubes passing through the aligned perforations in the end lugs of the grid elements.

The individual grid elements in the punchedgrid resistor bank are electrically connected in series. To accomplish this, while achieving the above-mentioned uniform spacing, the grid elements are spaced apart from one another by annular spacers on each of the insulating tubes. These annular spacers are alternately conductive or insulative. For example, the first and second, third and fourth, fifth and sixth, etc., grid elements are electrically connected together at the end lugs along one insulating tube. Along the opposite insulating tube, the second and third grid elements, the fourth and fifth grid elements, etc., are electrically connected together.

Suitable electrical terminals are mounted on the insulating tubes in contact with selected grid elements to provide connecting terminals at, for example, the ends of the series connection of grid elements and at desired tap points therebetween.

Such punched-grid resistors formed from grid elements having a one-half inch wide flat strip have been widely used. Single bank and double bank (two side-by-side banks having interconnected elements to produce a single series connection) assemblies of grid elements of this width have been used in various applications to successfully handle currents up to about 125 amps. However, such one-half inch width grid resistors have insufficient current-carrying capability for use in transit car resistor boxes of the type described above, where the current demands are on the order of 300 amps.

Punched-grid resistors utilizing a seven-eighths inch wide strip for the grid elements have also been used for a number of years. These wider grid elements permit an increased current-carrying capability; but, so far as applicant is aware, such wider element grid resistors have only been used in single banks. In such a configuration, this wider grid resistor is also incapable of meeting the resistance and current requirements for a transit car resistor box, within the "envelope" space constraints outlined earlier.

So far as applicant is aware, such wider (i.e., greater than one-half inch) element grid resistors have also typically been used with a spacing between the grid elements of one-half inch or greater. It has generally been accepted that adequate cooling air flow between such grid elements is only provided by using such a half-inch spacing, and it was believed that improved cooling (and hence, improved current-carrying capacity) would be obtained by even further increasing the spacing beyond one-half inch. Conventional wider element grid resistors of this type, with the above-mentioned element spacing requirement, would be incapable of providing the needed resistance and current-carrying capacity for a transit car resistor box having "envelope" dimensions such as those described above.

Consequently, it is a further object of the present invention to provide a punched-grid resistor box for a transit car which overcomes the foregoing difficulties with known punched-grid resistor structures.

This objective has been accomplished in accordance with certain principles of the invention by providing a multiple bank punched-grid resistor assembly utilizing grid elements having a width greater than one-half inch and wherein the spacing between the elements is greatly reduced from the previously prescribed one-half inch. In one embodiment of the invention, the punch-grid resistor box takes the form of a stacked pair of dual bank grid element arrays in which the elements are spaced apart a distance of about one-quarter inch.

In accordance with yet another objective of the present invention, a particular form of punched-grid resistor element has been modified to improve the performance of the element and the performances of resistors constructed from such elements. The improved punched-grid resistor element will find use in many applications, not only the transit car resistor box to be described hereinafter.

The prior resistor grid element is somewhat similar to the above-described patented element and includes a flat strip forming a circuitous path with three open-ended loops therein. The shape of each loop is such that a pair of closely spaced sections which are of uniform cross-section and size and having a narrow space therebetween, are connected together at a common end. It was found, during high current flow operation, that there was a cold spot at the extreme tip area of each common end, while there was a hot spot nearer the narrow space between the closely spaced sections. This lack of uniformity of temperature distribution under load meant that optimum use was not being made of the mass of the resistor element.

In this particular prior grid element, the general width of the grid strip through the circuitous path is seven-eighths inches. However, the distance from the outermost point of the narrow space between the two closely spaced sections to the tip of the loop is about one and one-fourth inches.

It has been found that temperature uniformity along the circuitous path of this grid element can be obtained by lengthening the narrow space between the two closely spaced sections of the loop. It has been found in particular, with a grid element of the aforementioned dimensions, that lengthening the narrow spacing to reduce the width of the strip at the tip of the loop from one and one-fourth inches to about one inch eliminates the hot spot in the vicinity of the opening and effects a more uniform current flow around the tip of the loop.

In providing a substantially uniform current flow through the grid element, the element is heated more evenly and therefore is more efficient at dissipating this heat energy. In the modified grid element, the effective current path is also lengthened. This results in an increase in resistance of the element of between 10 percent and 15 percent.

This resistance increase permits the use of a thicker grid element, having better current-carrying capability, while yet maintaining the same resistance as the prior, thinner element. For example, it has been found that a grid resistor element of the new configuration having a 12-gauge thickness has approximately the same resistance as the prior form of element witha 13-gauge thickness.

It has been found that the new, thicker element has a slightly improved steady state current-carrying capability relative to that of the prior, thinner element. There is also a significant improvement in the intermittent current capacity of the new, thicker element relative to the prior, thinner element. Due to increasing the mass of metal (while maintaining the same resistance) the time which it takes to heat up the element under intermittent current conditions is increased. Accordingly, for a given intermittent current load the new, thicker element remains cooler. It is beneficial to reduce the maximum temperature achieved during intermittent operation, such as in the case of a grid resistor for a transit car, since the degree of such heating is directly related to the rate of oxidation and deterioration of the grid elements.

With prior resistor banks of a given space envelope, two of the significant performance limitations are the continuous and more particularly intermittent current ratings of the bank. These are presently dependent, among other things, on the mass and surface area of the resistor elements and the associated ability to cool the elements.

It has thus been a still further and highly important objective of the invention to provide, for any predetermined space envelope, a resistor having the capacity for improved continuous and intermittent current ratings over those previously known punched-grid resistor banks.

Further objects and advantages of the invention, and the manner of their implementation, will become apparent upon reading the following detailed description and upon reference to the drawings, in which.

Figure 1:
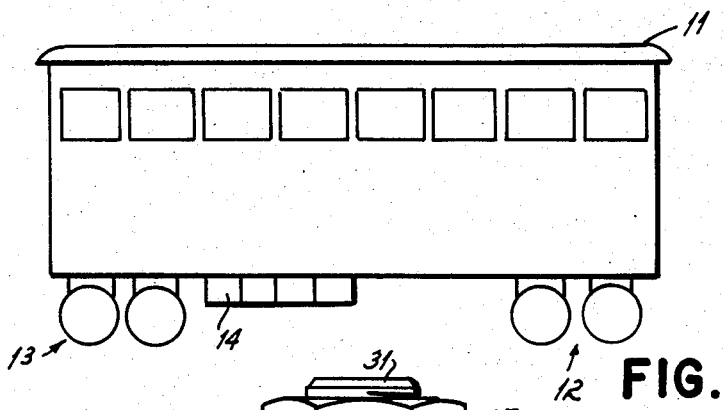
FIG. 1 is a diagrammatic side view of an electric motor-driven transit car showing the general location of the resistor boxes for the car.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With initial reference to FIG. 1, an electric motor-driven transit car 11 is supported upon front and rear wheel assemblies 12, 13, respectively. Mounted beneath the car between the front and rear wheels are two rows of resistor boxes, one row on each side of the car. For example, as illustrated, a row of five resistor boxes 14 is mounted beneath the near side of the car between the front and rear wheels.

Figure 3:
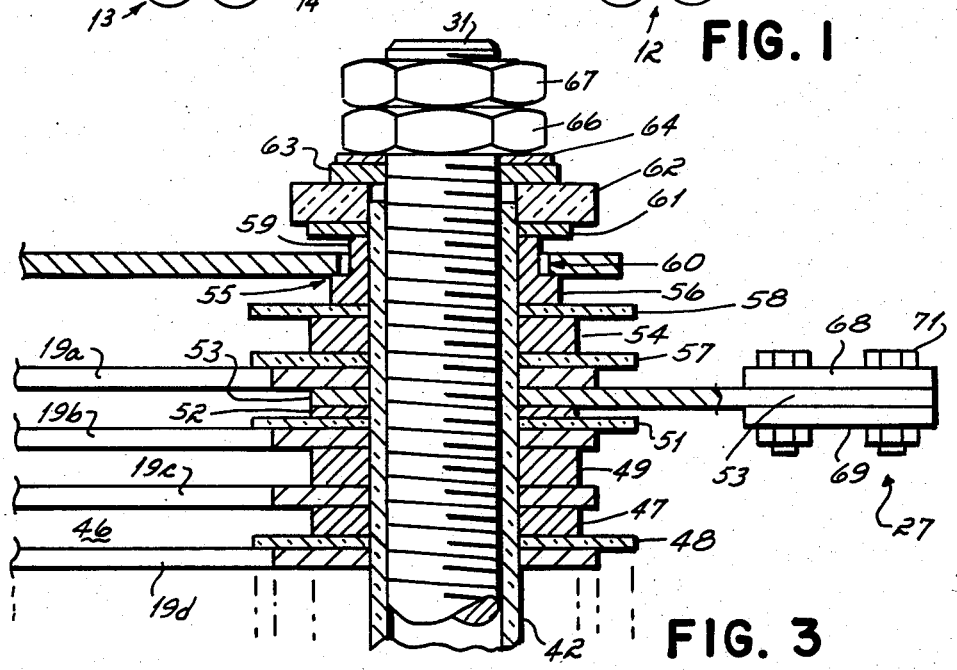
FIG. 3 is an enlarged sectional view of a portion of the resistor box of FIG. 2.
Figure 4:
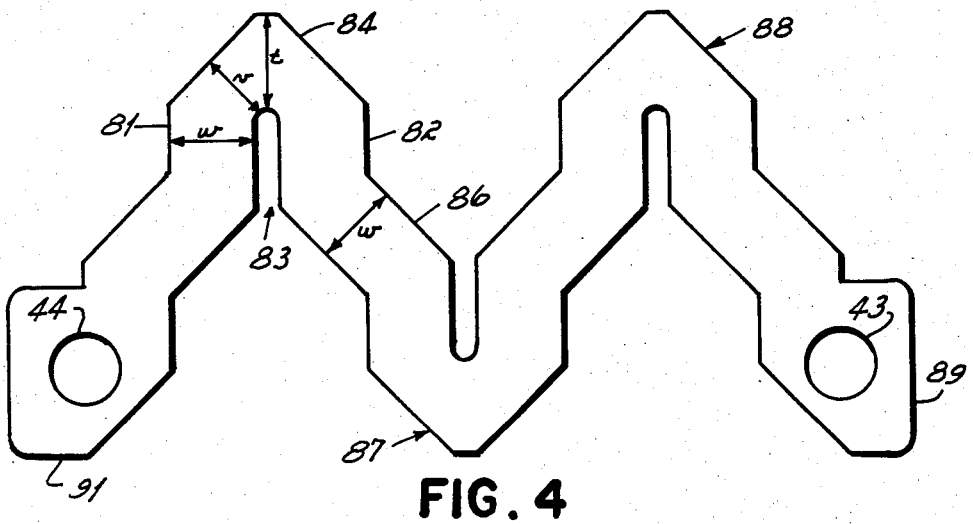
FIG. 4 is a side view of a grid element of the resistor box of FIG. 2.
Figure 2:
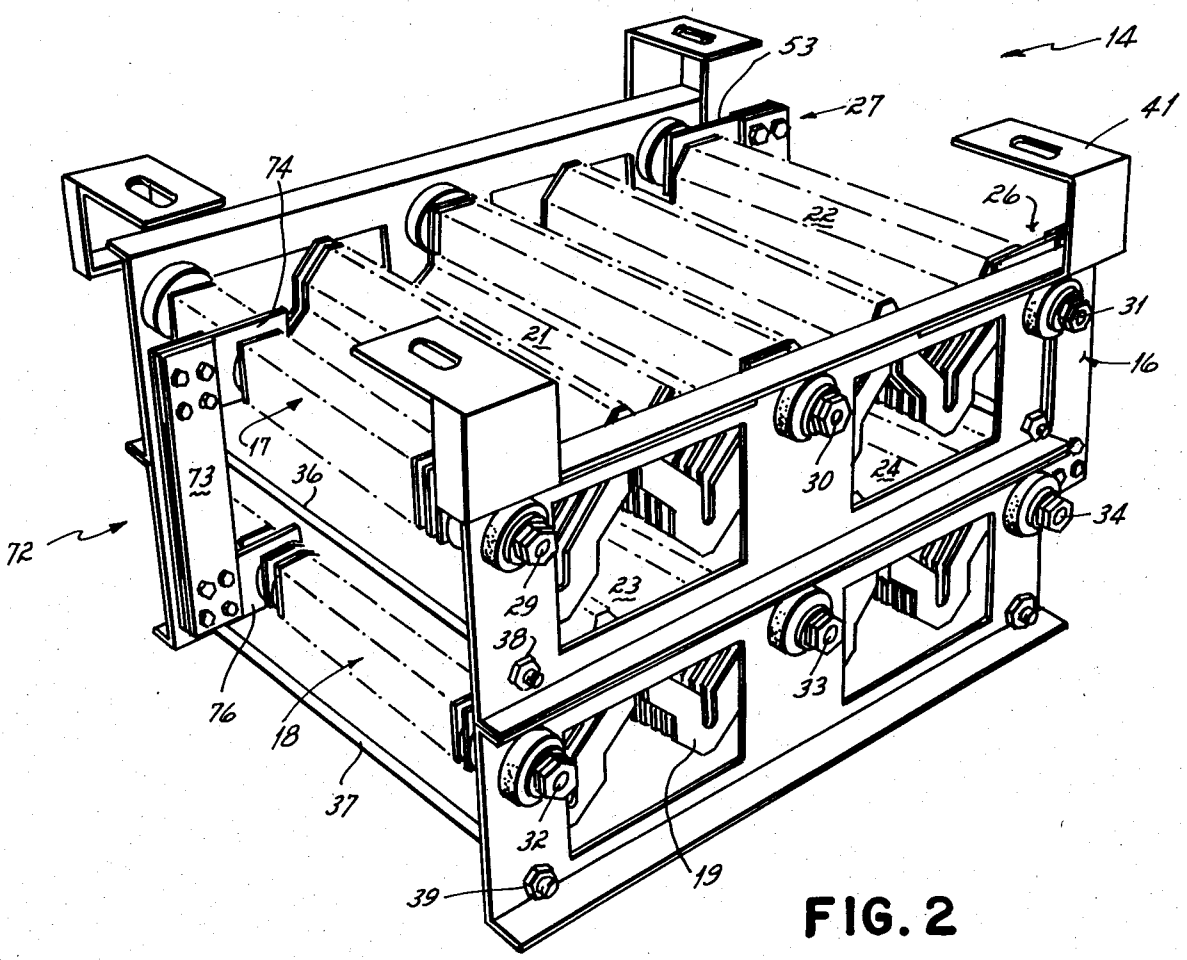
FIG. 2 is a perspective view of a resistor box for the car of FIG. 1 in accordance with the present invention.

In accordance with the present invention, an exemplary resistor box 14 for either replacement or original use with the car 11 takes the form of a grid resistor assembly. With reference now to FIGS. 2–4, the resistor box assembly 14 includes a frame 16 supporting an upper two bank grid resistor assembly 17 and a lower two bank grid resistor assembly 18 of punched-grid resistor elements such as 19. The upper assembly 17 of grid elements 19 is made up of two banks 21, 22 of grid elements. The lower assembly 18 of grid elements is likewise made up of two banks 23, 24 of grid elements.

Each element in the bank 21 of the upper assembly 17 is electrically connected in series with one side-by-side adjacent element in the bank 22. The electrical current path through the assembly 17 extends in a zig-zag fashion from the right front of the bank 22 to the right rear of the bank 22. In similar fashion, the assembly 18 of grid elements is electrically connected in series in a zig-zag fashion from the right front of the bank 24 to the right rear (not shown) of the bank 24. The two assemblies of grid elements are terminated at each end of their respective resistance paths by terminal assemblies 26, 27 which serve to electrically connect the two resistor assemblies in parallel.

In order to support the elements 19 within the frame 16, the grid elements 19 are carried upon six threaded rods 29–34 secured to the frame 16. The grid elements 19 are electrically insulated from the threaded rods 29–34 and from the frame 16, as shall be described.

The elements 19 are spaced apart from one another by spacer rings, also carried on the rods 29–34, and when the threaded rods are secured to the frame by nuts, the spacers and elements are held within the frame, providing rigidity to the frame structure. The frame is also held together by a pair of rods 36, 37 extending between the front and rear of the frame 16 on one side of the frame. The rods 36, 37 are secured by nuts such as 38, 39 at the front and rear of the frame. A similar pair of rods (not shown) are secured to the frame on its other side. The top of the frame 16 includes four apertured L-brackets such as 41 to secure the box 14 to the underside of the transit car 11 (FIG. 1).

The mounting of the electrical terminal assemblies and grid elements upon the rods 29–34, and the attachment of the rods to the frame 16, shall now be considered in more detail. Since each of these assemblies are substantially the same, only one shall be described in detail.

With particular reference to FIG. 3, the threaded rod 31, serving as one support for the bank 22 of grid elements, is secured to the rear of the frame 16 and carries one end of the grid elements of the bank 22, including the elements 19*a*–19*d*. In one form of resistor box 14, for example, the threaded rod 31 supports one end of 34 grid elements. In the illustrated form of the invention, the grid elements 19 (and the other current-carrying elements) are electrically conductive stainless steel. The grid elements 19 are a uniform thickness 12-gauge stainless steel and have a resistance of approximately 0.0068 ohms.

The grid elements 19 are electrically insulated from the rod 31 by a mica tube 42 which surrounds the rod 31 extending along the length of the rod within the frame 16 and extending slightly outward from the frame at each end. The rod 31 and mica tube 42 are received in an aperture 43 (FIG. 4) in one end of each element 19. The other end of each element 19 includes an aperture 44 which, in the case of the bank 22 of grid elements, receives the threaded rod 30, also enclosed within a mica tube.

In order to obtain the earlier-described series connection of the grid elements 19 throughout the resistor assembly 17, every other space between adjacent grid elements such as the elements 19*a*–19*d* on the rod 31 must be electrically insulated. This pattern is followed on the outer rods 29 and 31 of the upper grid assembly 17 and on the outer rods 32 and 34 of the lower grid assembly. For the rods 30 and 33, each of which support both banks of a grid assembly, each side-by-side pair of grid elements is in electrical contact and each such pair is electrically insulated from the adjacent pairs in front of and behind it.

To illustrate the pattern for the rod 31, in the space 46 between the grid elements 19*c* and 19*d*, the elements are spaced apart from one another by a metal ring 47 and an insulating mica washer 48, both of which are apertured to receive the rod 31 and mica tube 42. In the illustrated resistor assembly, the spacing between the elements 19 is one-quarter inch, with the spacer 47 having a thickness of three-sixteenths of an inch and the mica washer 48 having a thickness of one-sixteenth of an inch.

Moving toward the rear of the frame 16, the grid elements 19*b* and 19*c* are electrically connected by a stainless steel spacer 49 which is one-fourth inch thick.

Moving further toward the rear of the frame 16, the grid elements 19*a* and 19*b* are insulated from one another by a mica washer 51. The elements 19*a* and 19*b* are also spaced apart from one another by a spacer 52 and terminal plate 53, as well as the mica washer 51, with, in the illustrated form of the invention, the combined thickness of the mica washer, the spacer, and the terminal plate being one-fourth inch.

The terminal plate is a rectangular stainless steel plate apertured near one end to receive the bolt 31 and mica tube 42. The terminal plate 53 is electrically connected to the adjacent grid element 19*a*, which is at one end of the series-connected grid elements of the banks 21 and 22. The terminal plate 53 extends outwardly beyond the grid elements 19 and serves to provide an electrical connection point for the electrical system of the transit car 11.

The end grid element 19a is spaced apart from the frame 16 by a spacer 54 and the larger-diameter portion 56 of a collar washer 55. To electrically insulate the end grid element 19a from the frame 16, a mica washer 57 is mounted between the element 19a and the spacer 54, and a second mica washer 58 is mounted between the spacer 54 and the larger diameter portion 56 of the collar washer 55.

The reducer diameter portion 59 of the collar washer 55 is received within a horizontal slot 60 in the frame 16. Each of the rods 29, 31, 32 and 34 is received in a collar washer in a slot such as 60 to permit expansion of the grid banks under high temperature conditions. The rods 30 and 33 are received in collar washers in holes in the frame 16 sized to prevent movement of the rods 30 and 33.

The reduced diameter portion 59 of the collar washer 55 extends slightly outwardly beyond the frame 16, and the mica tube 42 protrudes slightly beyond the end of the collar washer. A thin metal washer 61 is received around the end portion of the mica tube 42 adjacent the reduced diameter portion 59 of the collar washer 55. A mica spacer 62 is received on the threaded rod 31. The mica spacer 62 surrounds the end portion of the mica tube 42 with the tube extending only partially into the spacer. A washer 63 is positioned on the rod 31 adjacent the mica spacer 62, and a lock washer 64 is received on the rod 31 adjacent the washer 63. The rod 31 is secured to the frame 16 by the nuts 66, 67, which, when tightened, compress the mica spacer 62 between the washers 61 and 63.

In order to connect the two grid assemblies 17, 18 in parallel, each electrical end of each assembly has an associated terminal plate such as the plate 53 in electrical contact with the end element, such as the element 19a. A terminal plate (not shown) at one end of the lower assembly 18 extends outwardly from the bank 24 below the plate 53 and is connected thereto by a pair of stainless steel bus bare 68, 69. The bus bars 68, 69 are secured to the upper and lower terminal plates by suitable bolts such as 71. Electrical connection to the transit car electrical system can be made, for example, by connecting one or more electrical conductors to the bolts 71.

At the front of the resistor box 14, the terminal assembly 26 includes a pair of bus bars electrically connecting an upper and lower terminal plate to provide an electrical connection between the upper and lower grid resistor element assemblies completing the parallel connection of the assemblies. The terminal assembly 26 further serves as a connection point for electrical conductors from the transit car electrical system.

Suitable additional terminal assemblies such as 72 may be provided at tap points along the series resistance paths of the resistor assemblies. The terminal assembly 72 includes bus bars such as 73 connecting an upper terminal plate 74 and a lower terminal plate 76, each of which is in electrical contact with a corresponding grid element 19 in the upper and lower grid assemblies 17, 18, respectively.

Referring now to FIG. 4, an exemplary grid element 19 is illustrated (inverted from the orientation of the elements in FIG. 2). Each grid element 19 of the resistor box 14 is of substantially uniform thickness and includes a pair of closely spaced sections 81, 82 of uniform cross-section and size having a narrow space 83 therebetween. The closely spaced sections 81, 82 are connected together at a common end 84. The closely spaced section 82 connects at its remaining end with an angularly divergent portion 86. The pair of closely spaced sections 81, 82 and their common end 84 form a loop, and the angularly divergent portion 86 connects this loop with a similar middle loop 87, which is in turn connected to a similar loop 88. These loops form a circuitous path extending between end lug portions 89, 91 which include the rod-receiving apertures 43, 44, respectively.

Typical of each loop, the upper (as shown in FIG. 4) edge of the divergent portion 86 forms an outside angle of about 135° with the outer edge of the closely spaced section 82. Similarly, the outer edge of the section 82 forms an outside angle of about 225° with the upper edge of the common end portion 84. Similar angles are formed on each side of each loop.

In the illustrated grid resistor element 19, the width w of the sections 81, 82 and 86, for example, as well as the corresponding sections in the remainder of the loops, is seven-eighths of an inch. In the illustrated grid element, the distance t in the end portion of each loop intermediate the sections 81, 82 is about fifteen-sixteenths of an inch. The distance v, the shortest, perpendicular, distance from the end portion 84 to the narrow space 83 is about eleven-sixteenths of an inch. The distance t would be about one inch if the lower edge of the end portion 84 were extended to form a point rather than being slightly flattened as illustrated.

What is claimed is:

1. A resistor box for an electric motor-driven transit vehicle comprising:

a frame sized to be received within an envelope of available space on the vehicle;

a plurality of grid resistor elements electrically connected in series mounted in the frame and electrically isolated therefrom to form a grid resistor assembly having a current-carrying capacity suitable for an electric motor-driven transit vehicle;

each said element comprising a flat strip having side portions of predetermined width, a loop end tip portion, and strip areas between said side portions and said tip portion being of lesser width than said side portions;

means for establishing electrical connections to selected grid resistor elements of the plurality of grid resistor elements; and means for mounting the frame on an electric motor-driven transit vehicle.

2. The resistor box of claim 1 in which each grid resistor element includes a pair of end mounting lugs connected by a flat strip forming a circuitous path having a succession of oppositely extending open-ended loops and in which at least some of said plurality of grid resistor elements are supported in the frame at the end mounting lugs to form a substantially uniform bank of said grid resistor elements.

3. The resistor box of claim 2 in which said plurality of grid resistor elements further comprises a second bank of grid resistor elements parallel to the first bank, each grid resistor element in the first bank being directly electrically connected in series with one grid resistor element in the second bank to form series pairs of grid resistor elements.

4. The resistor box of claim 3 in which all of said series pairs of grid resistor elements are electrically connected in series to form a two banks grid resistor assembly.

5. The resistor box of claim 4 which further comprises a second grid resistor assembly, substantially identical to the first grid resistor assembly, electrically connected in parallel with the first grid resistor assembly.

6. A grid resistor comprising:

a plurality of grid resistor elements each including a pair of end mounting lugs connected by a flat strip greater than one-half inch in width forming a circuitous path having a succession of oppositely extending open-end loops;

each said loop having side portions of predetermined width, a tip portion, and intermediate strip portions between said side portions and said tip portion which intermediate strip portions are of lesser width than said side portions; and means for mounting the grid resistor elements of said plurality of grid resistor elements to form a substantially uniform row of grid resistor elements spaced apart from one another a distance less than one-half inch.

7. The grid resistor of claim 6 in which the grid resistor elements are spaced apart from one another between one-fourth inch and five-sixteenths of an inch.

8. The grid resistor of claim 6 in which the width of the flat strip of each grid resistor element is seven-eighths inches.

9. The grid resistor of claim 8 in which the grid resistor elements are spaced apart from one another one-fourth inch.

10. A grid resistor element for a grid resistor assembly including a pair of end lugs connected by a flat strip forming a circuitous path defining a succession of oppositely extending open-ended loops connected in series between the lugs, each loop having a pair of closely spaced sections of width w with a narrow space therebetween and connected together at a common end, the width of the strip intermediate the closely spaced sections having a greatest width t, and the width of the common end between at least one of said closely spaced sections of width w and the portion of the common end of width t being at its narrowest point, a width v, wherein the width v is less than the width w.

11. The grid resistor element of claim 10 in which the width t is greater than the width w.

12. The resistor element of claim 11 in which the width w is seven-eighths inches.

13. The grid resistor element of claim 12 in which the width v is about eleven-sixteenths inches.

14. The grid resistor element of claim 13 in which the width t is between fifteen-sixteenths inches and one inch.

15. A grid resistor comprising:

a plurality of grid resistor elements each including a pair of end mounting lugs connected by a flat strip greater than one-half inch in width forming a circuitous path having a succession of oppositely extending open-ended loops;

each said loop having side portions of predetermined width, a tip portion, and intermediate strip portions between said side portions and said tip portion which intermediate strip portions are of lesser width than said side portions; and means for mounting the grid resistor elements so that a first portion of the grid resistor elements are positioned to form a first substantially uniform bank of grid resistor elements and a second portion of the grid resistor elements are positioned to form a second substantially uniform bank of grid resistor elements, each grid resistor element in the first bank being directly electrically connected in series with one grid resistor element in the second bank to form series pairs of grid resistor elements.

16. The grid resistor of claim 15 in which all of said series pairs of grid resistor elements are electrically connected in series to form a two bank grid resistor assembly.

17. The grid resistor of claim 16 in which the width of the flat strip of each grid resistor element is seven-eighths inches.

18. A grid resistor comprising:

a frame defining a predetermined resistor envelope;

a plurality of grid resistor element means for resisting current applied thereto and operationally connected together and mounted in adjacent parallel rows within said envelope, said grid element means comprising flat strips in excess of one-half inch in width and defining a serpentine path including at least one open-ended loop;

each said loop having side portions of predetermined width, a tip portion, and intermediate strip portions between said side portions and said tip portion which intermediate strip portions are of lesser width than said side portions;

means for connecting said grid resistor element means to a source of electrical current; and said grid resistor element means carrying current throughout said means and through said open-ended loop and being substantially uniformly heated through said loop upon the application of intermittent current thereto.

19. A grid resistor element for a grid resistor assembly including a pair of end lugs electrically connected by a flat strip defining a serial succession of oppositely extending open-ended loops between the lugs, each loop having a pair of spaced apart side sections, each of a width w and being connected together at a common end section to define said loop, the width of the common end section intermediate the spaced apart side sections having a greatest width t, and the width of the common end sections, between at least one of the said spaced apart side sections and the portion of the common end section of width t, being at its narrowest point a width v, wherein the width v is less than the width w.

20. The grid resistor element of claim 19, wherein said spaced apart side sections are parallel and are spaced apart a distance less than the width v.

21. The grid resistor element of claim 19 or claim 20 in which the width t is greater than the width w, wherein the width w is about seven-eighths inches, the width v is about eleven-sixteenths inches, and the width t is between about fifteen-sixteenths inches and about one inch.

22. A grid resistor element for a grid resistor assembly, said element comprising a flat strip defining at least one open-ended loop having side portions of predetermined width, a loop end tip portion connecting said side portions and strip areas between each said side portion and said loop end tip portion, said strip areas having a width less than that of said side portions.

23. A grid resistor element as in claim 22, wherein said loop is substantially uniformly heated upon application of a current to said element.

* * * * *